US010605238B2

(12) United States Patent
Chu

(10) Patent No.: US 10,605,238 B2
(45) Date of Patent: Mar. 31, 2020

(54) CONTROL VALVE FOR COMPRESSOR

(71) Applicant: Henry C. Chu, Orange, CA (US)

(72) Inventor: Henry C. Chu, Orange, CA (US)

( * ) Notice: Subject to any disclaimer, the term of this patent is extended or adjusted under 35 U.S.C. 154(b) by 183 days.

(21) Appl. No.: 15/790,111

(22) Filed: Oct. 23, 2017

(65) Prior Publication Data

US 2019/0120220 A1 Apr. 25, 2019

(51) Int. Cl.
*F04B 27/18* (2006.01)

(52) U.S. Cl.
CPC .. *F04B 27/1804* (2013.01); *F04B 2027/1813* (2013.01); *F04B 2027/1827* (2013.01); *F04B 2027/1831* (2013.01); *F04B 2027/1845* (2013.01)

(58) Field of Classification Search
CPC ..... Y10T 137/86622; F04B 27/1804; F04B 2027/1813; F04B 2027/1831; F04B 2027/1827; F04B 2027/1836
See application file for complete search history.

(56) References Cited

U.S. PATENT DOCUMENTS

| | | | | |
|---|---|---|---|---|
| 5,025,636 | A | 6/1991 | Terauchi | |
| 5,071,321 | A | 12/1991 | Skinner et al. | |
| 5,092,741 | A | 3/1992 | Taguchi | |
| 5,152,673 | A | 10/1992 | Pettitt et al. | |
| 5,167,492 | A | 12/1992 | Kent et al. | |
| 5,240,385 | A | 8/1993 | Nashiro et al. | |
| 5,586,870 | A | 12/1996 | Kawaguchi et al. | |
| 6,241,484 | B1 | 6/2001 | Hiltemann | |
| 6,250,891 | B1 | 6/2001 | Kawaguchi et al. | |
| 2015/0219082 | A1* | 8/2015 | Ota | F04B 27/0895 417/213 |

* cited by examiner

*Primary Examiner* — Kenneth J Hansen
(74) *Attorney, Agent, or Firm* — Charles E. Baxley

(57) ABSTRACT

A compressor includes a cylinder housing having a number of pistons, a control chamber communicating with piston casings, a suction chamber and a discharge chamber communicating with the piston casings, a control valve includes a receptacle engaged in the cylinder housing, a valve member engaged in the receptacle for controlling the pressurized air to flow from the discharge chamber into the control chamber of the cylinder housing, and a valve element for controlling a bypass of the pressurized air through the receptacle. A bellow device is connected to actuate the sliding member internally, and a sliding member is slidably engaged in the control space of the receptacle, and to operate the valve element externally with a solenoid device.

7 Claims, 5 Drawing Sheets

CONTROL VALVE FOR COMPRESSOR

BACKGROUND OF THE INVENTION

1. Field of the Invention

The present invention relates to a control valve for compressor, and more particularly to an internally and externally controlled control valve for a variable displacement compressor of a refrigeration system including an improved and simplified structure or configuration for allowing the compressor of the refrigeration system to be effectively actuated or operated by the internally and externally controlled control valve.

2. Description of the Prior Art

Typical refrigerating systems, such as the automotive air conditioning systems comprise a refrigerant circuit having a condenser, an evaporator, and a wobble plate type or slant plate type compressor with a variable displacement mechanism, in which the variable displacement mechanisms may be controlled either internally or externally.

For example, U.S. Pat. No. 5,071,321 to Skinner et al., U.S. Pat. No. 5,092,741 to Taguchi, U.S. Pat. No. 5,152,673 to Pettitt et al., and U.S. Pat. No. 5,167,492 to Kent et al. disclose several of the typical variable displacement mechanisms for wobble plate type or slant plate type compressors controlled internally with bellow devices or the like, and controlled by a suction chamber pressure and in response to a discharge chamber pressure and a crankcase pressure formed inside a crankcase chamber.

A "bellow" device, such as a sylphon bellow is a thin-walled cylindrical metal bellow consisting of elements arranged responding to external or internal fluid pressure, and used in a pressure-governing system. The control mechanism comprises a passage way communication between the crankcase chamber and discharge chamber. A control valve is in response to a pressure difference between the crankcase chamber and the discharge chamber and provides a fluid path between the crankcase chamber and the discharge chamber to allow refrigerant from the discharge chamber to be injected into the crankcase chamber through the fluid path provided by the control valve under the influence of the pressure of the pressure difference inside the suction chamber. The "bellow" device is responsive by a suction pressure connected to the suction chamber for allowing the wobble plate type or slant plate type compressors to be controlled internally with bellow devices or the like.

However, the typical variable displacement mechanisms for wobble plate type or slant plate type compressors should normally be actuated or operated at a rate ranging between 6-100%, and may not be shut off completely while in use, without an outside of compressor control device, such as a clutch device or a solenoid device.

U.S. Pat. No. 5,240,385 to Nashiro et al., U.S. Pat. No. 5,586,870 to Kawaguchi et al., U.S. Pat. No. 6,241,484 to Hiltemann, and U.S. Pat. No. 6,250,891 to Kawaguchi et al. disclose the other typical variable displacement mechanisms for wobble plate type or slant plate type compressors controlled externally with vehicle electrical control unit (ECU) or vehicle electrical control module (ECM), including a "solenoid" inside the control valve and disposed between a discharge chamber and a crankcase chamber, for controlling a crankcase pressure in response to a signal generated outside of the compressor, such as the vehicle electrical control unit (ECU) or vehicle electrical control module (ECM).

However, the typical variable displacement mechanisms for wobble plate type or slant plate type compressors may only be controlled externally with the signals from the vehicle electrical control unit (ECU) or vehicle electrical control module (ECM), and should normally be actuated or operated at a fast speed such that the working life of the typical variable displacement mechanisms will be greatly reduced or decreased.

U.S. Pat. No. 5,025,636 to Terauchi discloses a further typical variable displacement mechanism for wobble plate type or slant plate type compressor that may be controlled both internally with such as a bellow device and externally with such as a solenoid device.

However, the typical variable displacement mechanisms include a complicated structure or configuration that may not be easily and quickly made or manufactured and that may include a complicated making or manufacturing procedure and that may include a greatly increased manufacturing cost or the like. The internally controlled mechanism and the externally controlled mechanism are spaced or separated from each other, but not in one control body unit.

The present invention has arisen to mitigate and/or obviate the afore-described disadvantages of the conventional control valves for compressors.

SUMMARY OF THE INVENTION

The primary objective of the present invention is to provide a control valve for compressor including an improved and simplified structure or configuration for allowing the compressor of the refrigeration system to be effectively actuated or operated by the internally and externally controlled control valve.

The other objective of the present invention is to provide a control valve for compressor including an improved and simplified structure or configuration having both internally controlled mechanism and externally controlled mechanism in one control body unit.

In accordance with one aspect of the invention, there is provided a control valve for a compressor, the compressor comprising a cylinder housing including a number of piston casings provided in the cylinder housing, the cylinder housing including a control chamber formed therein and communicating with the piston casings of the cylinder housing, a suction chamber and a discharge chamber formed in the cylinder housing and communicating with the piston casings, and arranged for allowing a fluid to be drawn from the suction chamber into the piston casings of the cylinder housing, and for allowing a compressed fluid to be discharged into the discharge chamber of the cylinder housing selectively, a compartment formed in the cylinder housing, a channel formed in the cylinder housing and communicating with the compartment and the suction chamber of the cylinder housing, a conduit formed in the cylinder housing and communicating with the compartment and the discharge chamber of the cylinder housing, a pathway formed in the cylinder housing and communicating with the compartment and the control chamber of the cylinder housing, a number of pistons slidably received and engaged in the piston casings of the cylinder housing respectively, a swash plate rotatably received and engaged in the control chamber of the cylinder housing with a spindle and adjustable relative to the spindle to different angles, and engaged with the pistons for changing and determining a moving stroke of the pistons, and a control valve including a receptacle engaged in the compartment of the cylinder housing, the control valve includes a valve member engaged in the receptacle for controlling the compressed fluid to flow from the discharge chamber and the conduit of the cylinder housing through the receptacle and into the pathway and the control chamber of the cylinder housing, and a valve element for controlling a bypass of the compressed fluid through the receptacle and for controlling the compressed fluid to flow from the discharge chamber to the control chamber of the cylinder housing in order to control or adjust the swash plate relative to the spindle to different angles.

The receptacle includes a control space formed in the receptacle and communicating with the pathway of the cylinder housing for allowing the air with a control pressure (Pc) to flow from the control space of the receptacle into the control chamber of the cylinder housing, a discharge space formed in the receptacle and communicating with the conduit of the cylinder housing for allowing the air with a discharge pressure (Pd) to flow from the discharge chamber and the conduit of the cylinder housing through the discharge space of the receptacle and into the control space of the receptacle, the valve member is provided between the discharge space and the control space of the receptacle for controlling the compressed fluid to flow from the discharge space to the control space of the receptacle.

The receptacle includes a sliding member slidably received and engaged in the control space of the receptacle, and the sliding member includes a valve piece for selectively engaging with a primary valve seat of the receptacle and for forming the valve member between the receptacle and the sliding member. The sliding member includes a bore formed therein and communicating with the control space of the receptacle for forming a bypass from the discharge passage of the receptacle into the bore of the sliding member and into the control space of the receptacle, and the valve element is provided in the bore and the bypass of the sliding member for controlling the compressed fluid to flow from the discharge space of the receptacle into the bore of the sliding member.

The sliding member includes an aperture formed therein and communicating with the bore of the sliding member and communicating with the control space of the receptacle. The sliding member includes a secondary valve seat formed therein, and a valve part slidably engaged in the bore of the sliding member for selectively engaging with the secondary valve seat of the sliding member and for forming the valve element in the sliding member. The receptacle includes a bellow device connected to the valve part for actuating the valve part to selectively engage with the secondary valve seat of the sliding member and to be selectively disengaged from the secondary valve seat of the sliding member.

The receptacle includes a suction space formed in the receptacle and communicating with the channel of the cylinder housing for allowing the air with a suction pressure (Ps) to flow from the suction space of the receptacle into the piston casings of the cylinder housing selectively, and the bellow device is disposed in the suction space of the receptacle. The receptacle includes a suction passage formed therein and communicating with the suction space of the receptacle for allowing the air to flow into the suction space of the receptacle.

The receptacle includes a solenoid device engaged with the sliding member for selectively actuating the sliding member to engage with or disengage from the primary valve seat of the receptacle. The solenoid device includes a coil attached to the receptacle, and a plunger slidably engaged in the coil and engaged with the sliding member for selectively actuating the sliding member to close and open the valve member. The receptacle includes a discharge passage formed therein and communicating with the discharge space of the receptacle, and a control passage formed in the receptacle and communicating with the control space of the receptacle for allowing the compressed fluid to flow from the control space to the control passage of the receptacle, and then into the control chamber of the cylinder housing.

Further objectives and advantages of the present invention will become apparent from a careful reading of the detailed description provided hereinbelow, with appropriate reference to the accompanying drawings.

DETAILED DESCRIPTION OF THE PREFERRED EMBODIMENT

Figure 1:
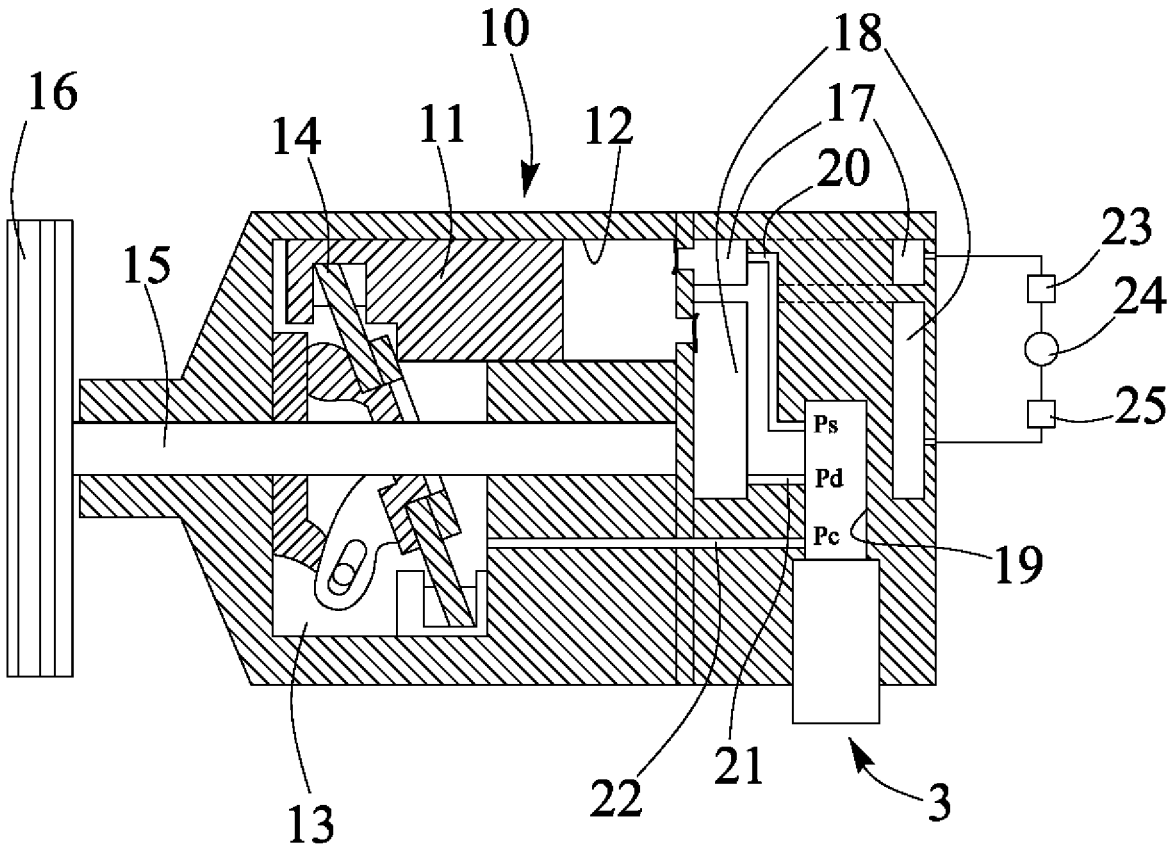
FIG. 1 is a partial cross sectional view of a compressor having a control valve in accordance with the present invention.
Figure 2:
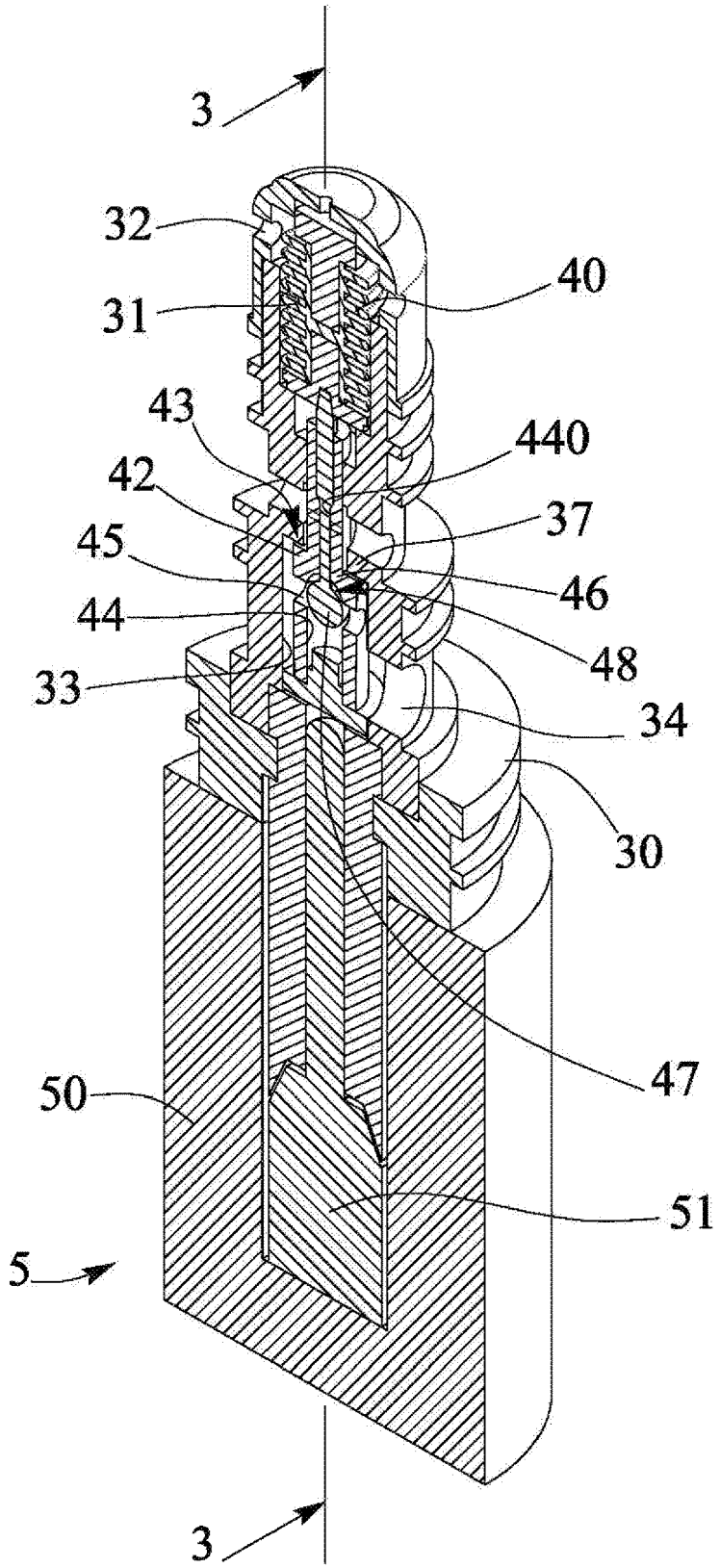
FIG. 2 is an enlarged partial perspective view illustrating the control valve for the compressor.

Referring to the drawings, and initially to FIG. 1, a compressor in accordance with the present invention comprises an outer receptacle or cylinder housing 10, and a number of pistons 11 slidably received or engaged in piston casings 12 that are formed and provided in the cylinder housing 10, and actuated or operated to move in a reciprocating action in the cylinder housing 10 for generating a pressurized air or compressed fluid, the cylinder housing 10 includes a crank case chamber or control chamber 13 formed therein and communicating with the piston casings 12, and a swash plate 14 is rotatably received or engaged in the control chamber 13 of the cylinder housing 10 with a spindle 15 and connected or coupled to and engaged with the pistons 11 for changing and determining the moving stroke of the pistons 11, in which the spindle 15 is substantially parallel to the pistons 11. A driven pulley 16 is connected or coupled to the spindle 15 and rotated in concert with the spindle 15.

When the swash plate 14 is tilted or adjusted relative to the spindle 15 to a substantially upright angle that is substantially perpendicular to the spindle 15, the moving stroke of the pistons 11 is decreased to the smallest; but when the swash plate 14 is tilted or adjusted relative to the spindle 15 to a substantially flat angle that is substantially parallel to the spindle 15, the moving stroke of the pistons 11 will be increased to the greatest moving stroke, for example, and the pressurized air or compressed fluid will be generated in the greatest efficiency. The cylinder housing 10 further includes a suction chamber 17 and a discharge chamber 18 formed therein and communicating with the piston casings 12 and arranged for allowing the air to be drawn from the suction chamber 17 into the piston casings 12, and for allowing the pressurized air or compressed fluid to be discharged into the discharge chamber 18 when or after the pressurized air or compressed fluid is generated by or with the pistons 11.

The cylinder housing 10 further includes a receiving chamber or compartment 19 formed therein and communicating with the suction chamber 17 and the discharge chamber 18 and the control chamber 13 of the cylinder housing 10 with a channel 20, a conduit 21 and a pathway 22 respectively, and the compartment 19 of the cylinder housing 10 may be provided for receiving or engaging with a control valve 3 that is provided for actuating or operating the compressor in accordance with the present invention. The compressor in accordance with the present invention further comprises a refrigerant circuit including at least an evaporator 23, an expansion valve 24 and a condenser 25 connected or coupled in series between the suction chamber 17 and the discharge chamber 18 of the cylinder housing 10 for air conditioning purposes. The above-described structure or configuration for the pistons 11 and the swash plate 14 and the evaporator 23 and the expansion valve 24 and the condenser 25 is typical and will not be described in further details.

Referring next to FIGS. 2-5, the control valve 3 for the compressor in accordance with the present invention includes a control valve body or receptacle 30 having a suction space 31 formed therein, such as formed in the upper portion thereof, a suction passage 32 formed therein, such as formed in the upper portion thereof and communicating with the suction space 31 of the receptacle 30 and also communicating with the channel 20 of the cylinder housing 10 for allowing the air with a suction pressure (Ps) to be flown from the suction space 31 of the receptacle 30 and through the channel 20 and into the piston casings 12 of the cylinder housing 10 selectively, and the suction space 31 of the receptacle 30 is provided for receiving or engaging with a bellow device 40, such as a thin-walled cylindrical metal bellow consisting of elements arranged responding to external or internal fluid pressure, and used in a pressure-governing system, and responsive by the suction pressure (Ps) connected to the suction chamber 17 of the cylinder housing 10.

For example, when the temperature and/or the pressure in the outer environment and/or the suction pressure (Ps) reach a predetermined value, such as 40 psi, the bellow device 40 will be compressed or actuated or operated by the suction pressure (Ps) in order to actuate or operate the control valve 3 to work the compressor, this is the so-called internally controlled wobble plate type or slant plate type or swash plate type compressors. The compressor will be continuously actuated or operated by the suction pressure (Ps) that is ranged between 30 and 40 psi, for example, and the compressor will be idled or the like when the suction pressure (Ps) is lower than 30 psi, for example. The above-described structure or configuration for the bellow device 40 is also typical and will not be described in further details.

The receptacle 30 further includes a crank case or control space 33 formed in the middle or intermediate portion of the receptacle 30, and a crank case or control passage 34 is also formed in the middle or intermediate portion of the receptacle 30 and communicating with the control space 33 of the receptacle 30 and also communicating with the pathway 22 of the cylinder housing 10 for allowing the air with a control pressure (Pc) to be flown from the control space 33 of the receptacle 3 and through the pathway 22 and into the control chamber 13 of the cylinder housing 10 in order to control or tilt or adjust the swash plate 14 relative to the spindle 15 of the cylinder housing 10. The receptacle 30 further includes an orifice or discharge space 35 formed therein and communicating with the suction space 31 and the control space 33 of the receptacle 30, and a discharge passage 36 also formed in the middle or intermediate portion of the receptacle 30 and communicating with the discharge space 35 of the receptacle 30 and also communicating with the conduit 21 of the cylinder housing 10 for allowing the pressurized air or compressed fluid generated by or with the pistons 11 with a discharge pressure (Pd) to flow into the discharge passage 36 and/or the control space 33 of the receptacle 30.

A container or sliding member 41 is slidably received or engaged in the control space 33 and/or the discharge space 35 of the receptacle 30, and includes a shoulder or valve piece 42 for selectively contacting or engaging with a primary valve seat 37 of the receptacle 30 and for forming or defining a primary valve member 43 between the receptacle 30 and the sliding member 41 and for controlling the pressurized air or compressed fluid (Pd) to flow from the discharge passage 36 into the control space 33 of the receptacle 30. The sliding member 41 includes an inner bore 44 and an aperture 45 formed therein and communicating with each other and also communicating with the control space 33 of the receptacle 30 for forming a manifold or bypass 440 of the pressurized air or compressed fluid from the discharge passage 36 of the receptacle 30 into the bore 44 and the aperture 45 of the sliding member 41 and into the control space 33 of the receptacle 30, and the aperture 45 of the sliding member 41 is communicating with the control space 33 of the receptacle 30, and the inner bore 44 of the sliding member 41 is partially communicating with the discharge passage 36 of the receptacle 30 for allowing the pressurized air or compressed fluid to partially flow from the discharge passage 36 of the receptacle 30, through the manifold or bypass 440 and into the bore 44 and the aperture 45 of the sliding member 41 selectively.

The sliding member 41 further includes an inner socket or secondary valve seat 46 formed or provided therein, and another valve ball or piece or part 47 is slidably received or engaged in the bore 44 of the sliding member 41 and attached or mounted or secured to the bellow device 40 and moved in concert with the bellow device 40 and arranged for allowing the valve part 47 to be actuated or operated or moved by the bellow device 40 to selectively contact or engage with the secondary valve seat 46 of the sliding member 41 in order to form or define a secondary valve element 48 within the sliding member 41, and to control the pressurized air or compressed fluid (Pd) to flow from the discharge passage 36 into the bore 44 and the aperture 45 of the sliding member 41 and then into the control space 33 of the receptacle 30 and then to selectively flow out through the control passage 34 of the receptacle 30, such that the bypass of the pressurized air or compressed fluid (Pd) from the discharge passage 36 of the receptacle 30 into the bore 44 of the sliding member 41 and then into the control space 33 of the receptacle 30 may be controlled with the valve part 47 and the secondary valve seat 46 of the valve element 48 and thus may be controlled internally with the valve part 47 and the bellow device 40.

The control valve 3 further includes a solenoid device 5 having a coil 50 disposed or attached or mounted or secured in the lower or bottom portion of the receptacle 30, and a plunger 51 slidably received or engaged in the coil 50 and contacted or engaged with the sliding member 41, for being actuated or operated by the coil 50 and for selectively actuating or forcing or moving the sliding member 41 to contact or engage with the primary valve seat 37 of the receptacle 30 (FIGS. 4, 5) and for closing or opening the valve member 43 selectively. A spring biasing member 52 is provided and engaged between the receptacle 30 and the sliding member 41 for biasing and forcing or moving the valve piece 42 of the valve member 43 from the primary valve seat 37 of the receptacle 30 or of the valve member 43 (FIG. 3) and thus for allowing the pressurized air or compressed fluid (Pd) to freely flow from the discharge passage 36 into the control space 33 of the receptacle 30.

Figure 3:
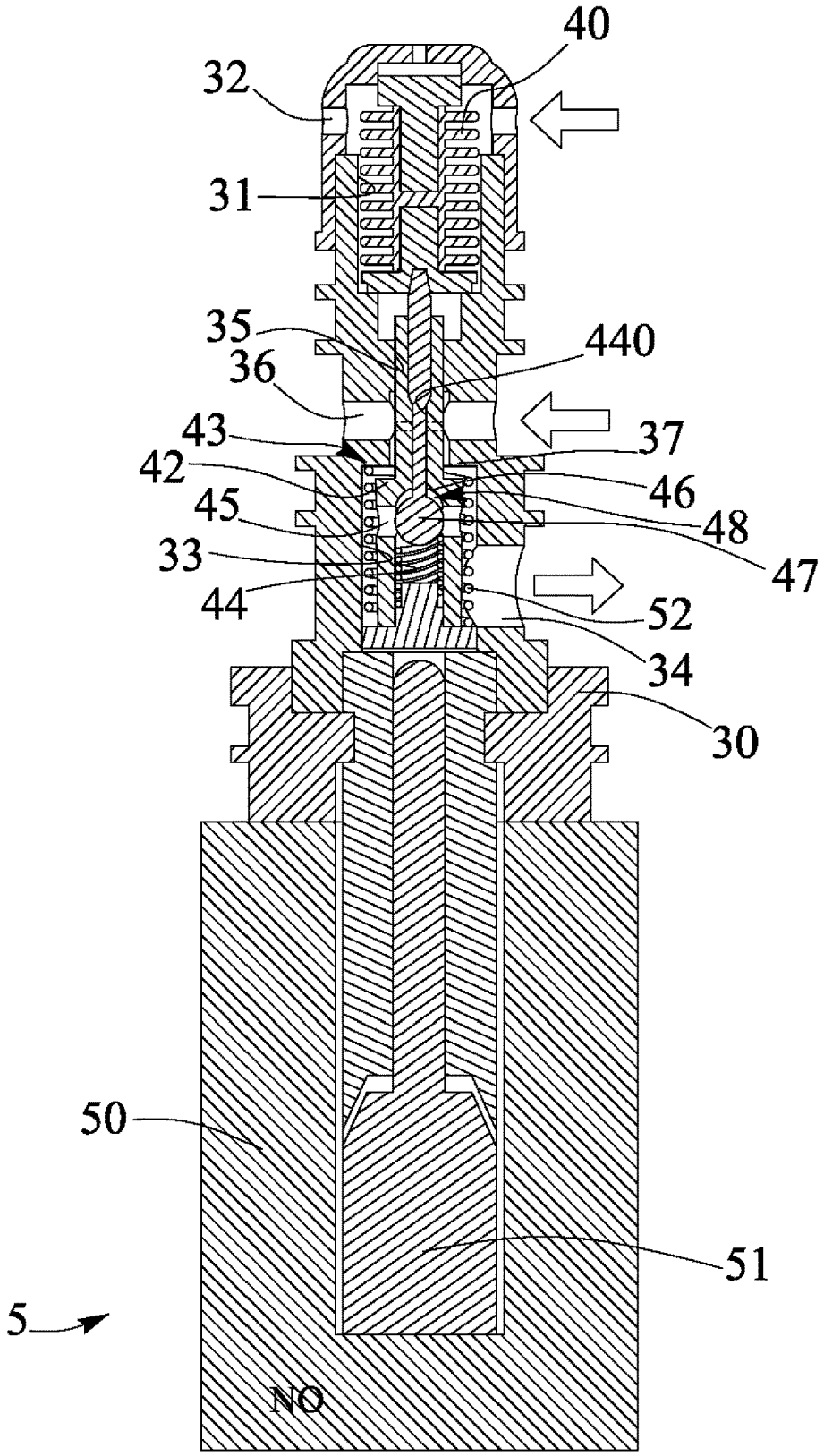
FIG. 3 is a partial cross sectional view of the control valve for compressor, taken along lines 3-3 of FIG. 2.

In operation, as shown in FIG. 3, when the coil 50 of the solenoid device 5 is not actuated or operated or when it is not required to be air conditioned, or when the suction pressure (Ps) is lower than a predetermined low value, such as 30 psi, the pressurized air or compressed fluid (Pd) may freely flow from the discharge passage 36 into the control space 33 of the receptacle 30 through the valve member 43, and then into the control chamber 13 of the cylinder housing 10 in order to tilt or adjust the swash plate 14 relative to the spindle 15 of the cylinder housing 10 to the substantially upright angle that is substantially perpendicular to the spindle 15, the moving stroke of the pistons 11 is decreased to the smallest and the work done by the compressor is decreased to almost zero.

Figure 4:
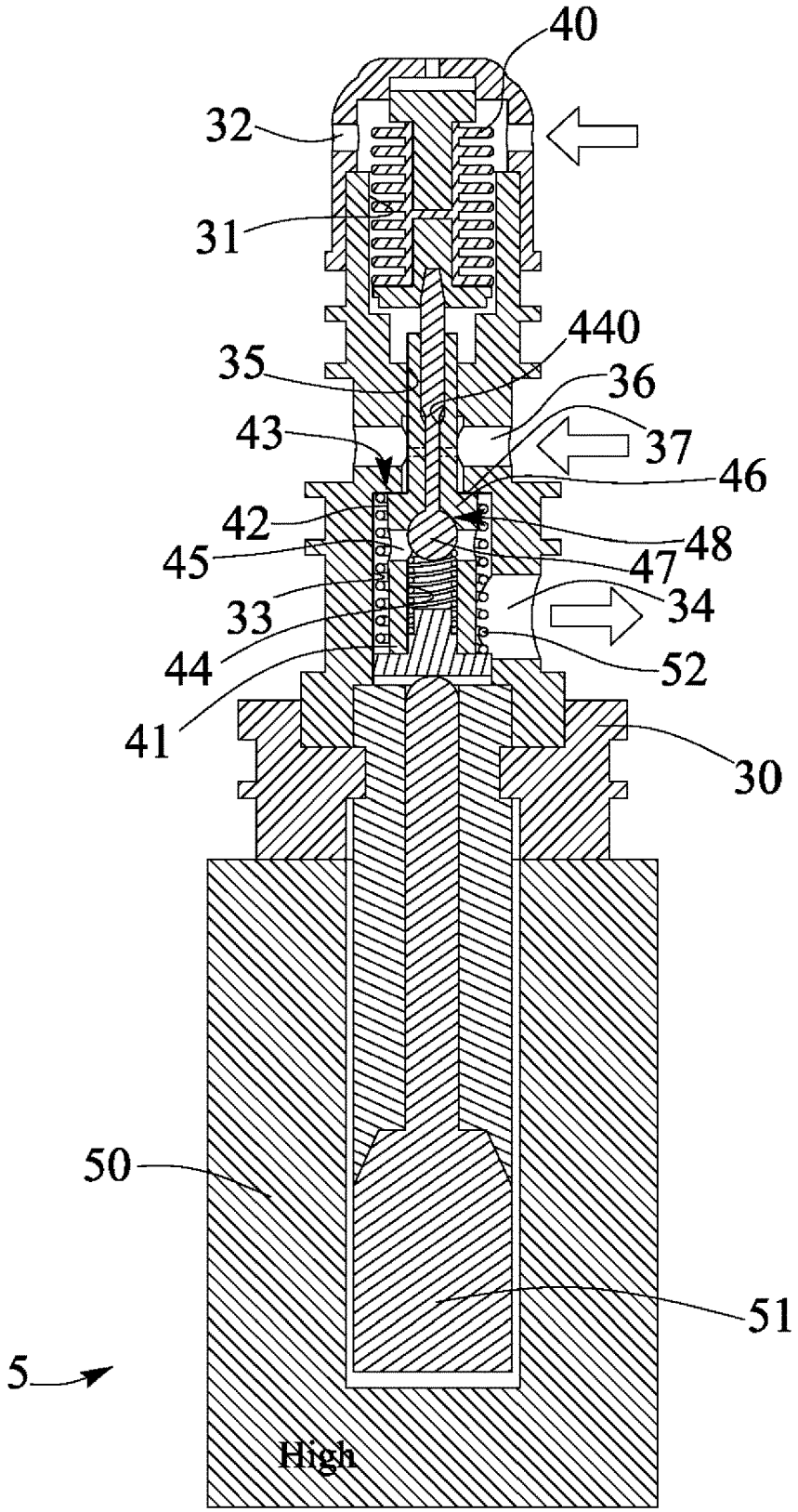
FIGS. 4, 5 are partial cross sectional views similar to FIG. 3, illustrating the operation of the control valve for compressor.
Figure 5:
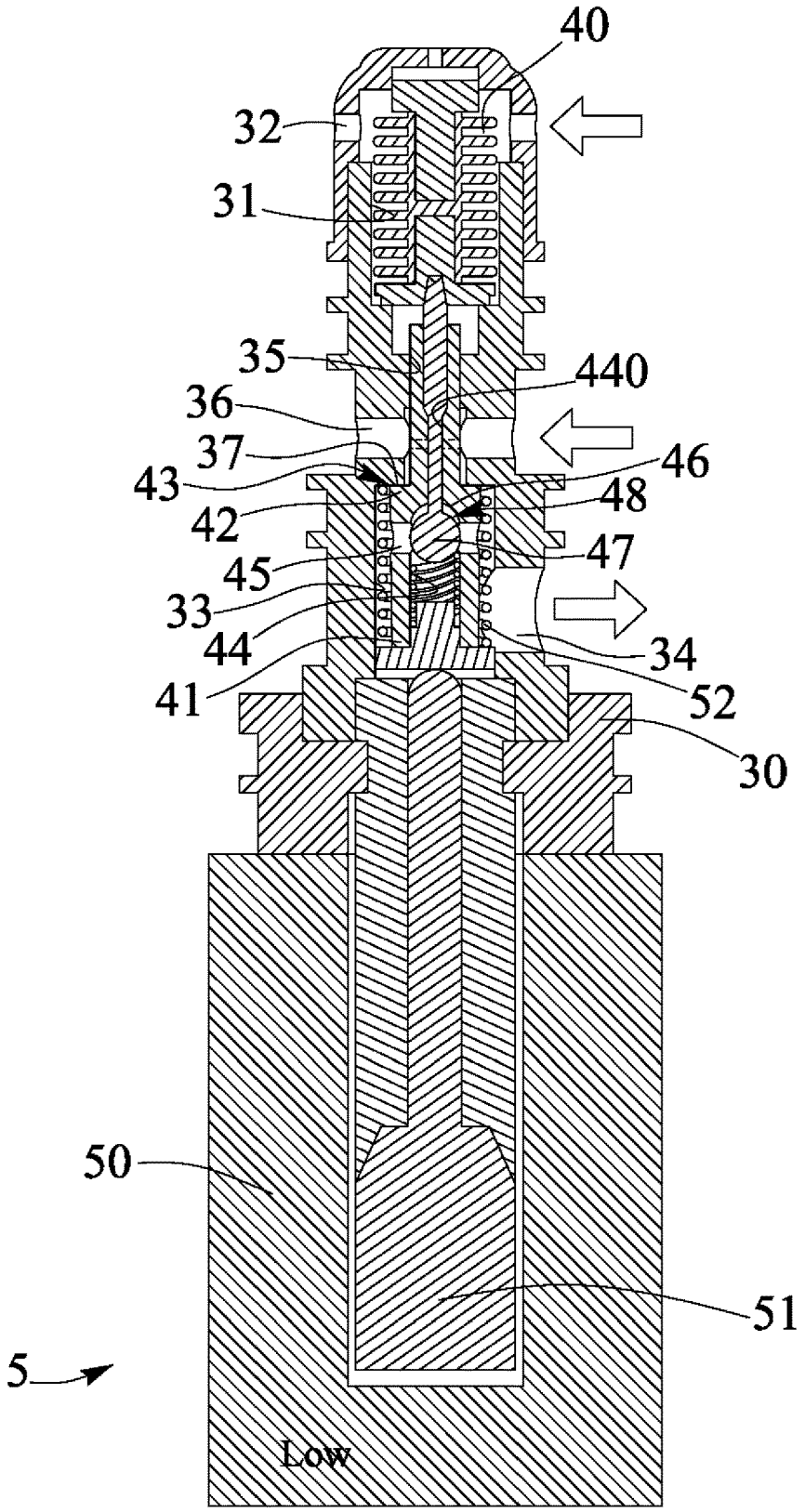

As shown in FIGS. 4 and 5, when it is required to be air conditioned, the coil 50 of the solenoid device 5 may be actuated or operated or energized with a signal generated outside of the compressor, such as the vehicle electrical control unit (ECU) or vehicle electrical control module (ECM), and the sliding member 41 may be actuated or operated or moved by the plunger 51 and/or the coil 50 of the solenoid device 5 to contact or engage with the primary valve seat 37 of the receptacle 30 and for closing the valve member 43 selectively and for preventing the pressurized air or compressed fluid (Pd) from directly flow from the discharge passage 36 through the valve member 43 that is formed by the primary valve seat 37 of the receptacle 30 and the valve piece 42 of the valve member 43, and then into the control space 33 of the receptacle 30.

As also shown in FIG. 4, when it is required to be air conditioned and when the temperature and/or the pressure in the outer environment and/or the suction pressure (Ps) reach the predetermined high value, such as 40 psi, the bellow device 40 will be compressed or actuated or operated by the suction pressure (Ps) in order to actuate or operate or move the valve part 47 to contact or engage with the secondary valve seat 46 of the sliding member 41 in order to close the valve element 48, at this moment, no pressurized air or compressed fluid (Pd) may flow from the discharge passage 36 into the control space 33 of the receptacle 30 and no pressurized air or compressed fluid (Pd) may be supplied into the control chamber 13 of the cylinder housing 10, and the swash plate 14 may be tilted or adjusted relative to the spindle 15 of the cylinder housing 10 to the substantially flat that is substantially parallel to the spindle 15, the moving stroke of the pistons 11 will be increased to the greatest moving stroke, and the pressurized air or compressed fluid will be generated in the greatest efficiency.

As also shown in FIG. 5, when the suction pressure (Ps) is ranged between 30 and 40 psi, for example, the valve part 47 of the bellow device 40 or of the valve element 48 will be compressed or actuated or operated by the suction pressure (Ps) in order to partially open the valve element 48 and thus for allowing the pressurized air or compressed fluid (Pd) to bypass and to partially flow from the discharge passage 36 of the receptacle 30 into the bore 44 of the sliding member 41 and then into the control space 33 of the receptacle 30, and thus for allowing the compressor will be continuously actuated or operated by the suction pressure (Ps) internally with the bellow device 40. It is to be noted that the valve member 43 is closed at this moment, and will not be further moved or opened by the plunger 51 and/or the coil 50 of the solenoid device 5. It is further to be noted that the valve element 48 and the valve member 43 are formed or provided within the receptacle 30, and the valve element 48 may be controlled internally with the valve part 47 and the bellow device 40, and the valve member 43 may be controlled externally with the plunger 51 and/or the coil 50 of the solenoid device 5.

Accordingly, the control valve for compressor in accordance with the present invention includes an improved and simplified structure or configuration for allowing the compressor of the refrigeration system to be effectively actuated or operated by the internally and externally controlled control valve, and having both internally controlled mechanism and externally controlled mechanism in one control body unit.

Although this invention has been described with a certain degree of particularity, it is to be understood that the present disclosure has been made by way of example only and that numerous changes in the detailed construction and the combination and arrangement of parts may be resorted to without departing from the spirit and scope of the invention as hereinafter claimed.

I claim:

1. A control valve for a compressor, said compressor comprising:

a cylinder housing including a number of piston casings provided in said cylinder housing, said cylinder housing including a control chamber formed therein and communicating with said piston casings of said cylinder housing, a suction chamber and a discharge chamber formed in said cylinder housing and communicating with said piston casings, and arranged for allowing a fluid to be drawn from said suction chamber into said piston casings of said cylinder housing, and for allowing a compressed fluid to be discharged into said discharge chamber of said cylinder housing selectively, a compartment formed in said cylinder housing, a channel formed in said cylinder housing and communicating with said compartment and said suction chamber of said cylinder housing, a conduit formed in said cylinder housing and communicating with said compartment and said discharge chamber of said cylinder housing, a pathway formed in said cylinder housing and communicating with said compartment and said control chamber of said cylinder housing, a plurality of pistons slidably received and engaged in said piston casings of said cylinder housing respectively, a swash plate rotatably received and engaged in said cylinder housing with a spindle and adjustable relative to said spindle, and engaged with said pistons for changing and determining a moving stroke of said pistons, and said control valve including a receptacle engaged in said compartment of said cylinder housing, said receptacle including a control space formed in said receptacle and communicating with said pathway of said cylinder housing for allowing the fluid with a control pressure (Pc) to flow from said control space of said receptacle into said control chamber of said cylinder housing, a discharge space formed in said receptacle and communicating with said conduit of said cylinder housing for allowing the fluid with a discharge pressure (Pd) to flow from said discharge chamber and said conduit of said cylinder housing through said discharge space of said receptacle and into said control space of said receptacle, said control valve including a valve member engaged in said receptacle and provided between said discharge space and said control space of said receptacle for controlling the compressed fluid to flow from said discharge chamber and said conduit of said cylinder housing through said receptacle and into said pathway and said control chamber of said cylinder housing, and a valve element for controlling a bypass of the compressed fluid through said receptacle, a sliding member slidably received and engaged in said control space of said receptacle, and said sliding member including a valve piece for selectively engaging with a primary valve seat of said receptacle and for forming said valve member between said receptacle and said sliding member, said sliding member including a bore formed therein and communicating with said control space of said receptacle for forming a bypass from said discharge space of said receptacle into said bore of said sliding member and into said control space of said receptacle, and said valve element being provided in said bore and said bypass of said sliding member, said sliding member including a secondary valve seat formed therein, and a valve part slidably engaged in said bore of said sliding member for selectively engaging with said secondary valve seat of said sliding member, said receptacle including a bellow device connected to said valve part for actuating said valve part to selectively engage with said secondary valve seat of said sliding member, and said receptacle including a suction space formed in said receptacle and communicating with said channel of said cylinder housing for allowing the fluid with a suction pressure (Ps) to flow from said suction space of said receptacle into said piston casings of said cylinder housing selectively, and said bellow device being disposed in said suction space of said receptacle.

2. The control valve for compressor as claimed in claim 1, wherein said sliding member includes an aperture formed therein and communicating with said bore of said sliding member and communicating with said control space of said receptacle.

3. The control valve for compressor as claimed in claim 1, wherein said receptacle includes a suction passage formed therein and communicating with said suction space of said receptacle.

4. The control valve for compressor as claimed in claim 1, wherein said receptacle includes a solenoid device engaged with said sliding member for selectively actuating said sliding member to engage with said primary valve seat of said receptacle.

5. The control valve for compressor as claimed in claim 4, wherein said solenoid device includes a coil attached to said receptacle, and a plunger slidably engaged in said coil and engaged with said sliding member for selectively actuating said sliding member to close and open said valve member.

6. The control valve for compressor as claimed in claim 1, wherein said receptacle includes a discharge passage formed therein and communicating with said discharge space of said receptacle, and a control passage formed in said receptacle and communicating with said control space of said receptacle.

7. The control valve for compressor as claimed in claim 1, wherein said swash plate is rotatably received and engaged in said control chamber of said cylinder housing with said spindle and adjustable relative to said spindle, and engaged with said pistons.

* * * * *